United States Patent [19]

Shibata et al.

[11] Patent Number: 4,588,353

[45] Date of Patent: May 13, 1986

[54] SUBMERSIBLE PUMP

[75] Inventors: Tomoyuki Shibata; Mitsuhito Nakayama, both of Kanagawa, Japan

[73] Assignee: Ebara Corporation, Tokyo, Japan

[21] Appl. No.: 611,985

[22] Filed: May 18, 1984

[30] Foreign Application Priority Data

May 24, 1983 [JP] Japan ..... 58-77973[U]

[51] Int. Cl.[4] ..... F04D 29/42

[52] U.S. Cl. ..... 415/197; 415/121 B; 415/219 C

[58] Field of Search ..... 415/196, 197, 213 A, 415/213 T, 215, 219 C

[56] References Cited

U.S. PATENT DOCUMENTS

| | | | |
|---|---|---|---|
| 1,638,055 | 8/1927 | Nagle | 415/196 X |
| 3,551,067 | 12/1970 | Wissman | 415/197 X |
| 3,576,380 | 4/1971 | Sargeant | 415/197 X |
| 3,692,422 | 9/1972 | Girardier | 415/215 X |

FOREIGN PATENT DOCUMENTS

| | | | |
|---|---|---|---|
| 2048087 | 5/1971 | Fed. Rep. of Germany | 415/213 A |
| 2036353 | 1/1972 | Fed. Rep. of Germany | 415/213 A |
| 2347333 | 4/1974 | Fed. Rep. of Germany | 415/196 |
| 719311 | 12/1954 | United Kingdom | 415/197 |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

A submersible pump especially usable for civil engineering works is provided in which a wear resistant protecting member is disposed at the portion opposing the backside of an impeller shroud to protect that portion from wear due to abrasion by earth and sand contained in the liquid handled by the pump. The protecting member is provided with holes or portions similar to holes which are adapted to surround the exposed portions of the bolts so as to prohibit the liquid flow from directly contacting the bolt portions with flowing speed or kinetic energy so that wear of the bolts is prevented.

5 Claims, 5 Drawing Figures

SUBMERSIBLE PUMP

FIELD OF THE INVENTION

The present invention relates to a submersible pump and more specifically to such a pump utilized for civil engineering works.

BACKGROUND OF INVENTION

In case of a submersible pump used for civil engineering works, a pump exhibiting high resistance against abrasion is usually required since liquid handled by such pump contains a substantial amount of earth and sand. Especially, when a connected pipe is bent due to its flexibility or when a delivery pipe is led to a high position and the level of liquid is relatively low so that air is likely to be introduced into the pump, the earth and sand introduced into the pump may whirl within the pump but may not be easily discharged outwardly from the pump. If the pump is operated for a long period under such conditions, the inner surfaces of the pump will be subjected to abrasion by the earth and sand. For instance, in the conventional pump comprising a motor section, a pump section and an intermediate casing between the two sections, the pump section including a semi-open type impeller, the surface of the intermediate casing facing the backside of the main plate of the impeller and the inner surface of the pump casing wall having a suction opening is subjected to severe abrasion. Also, the intermediate casing is usually secured to the motor casing of the motor section in such pump by plural bolts whose heads are exposed to the impeller chamber of the pump casing and, thus, the heads of the bolts are subjected to abrasion to become unrotatable by wear thereby causing the pump to be incapable of being disassembled.

If such pump is arranged to be a vortex pump wherein a vortex chamber is provided between an open end side of the semi-open type impeller and the end wall of the pump casing having the suction opening, wear on the inner surface of the end wall would be remarkably reduced since the flowing speed of the liquid near the inner surface of the end wall is reduced due to the presence of the space between the open end of the impeller and the inner surface of the end wall. However, the wear due to abrasion of the bolt heads and the surface of the intermediate casing may not be effectively prevented by the mere presence of the vortex chamber.

SUMMARY OF INVENTION

Accordingly, it is an object of the present invention to provide a submersible pump which is adapted to be used in civil engineering works and to withstand abrasion due to the action of earth and sand contained in the liquid to be handled.

It is, thus, an object of the present invention to provide a submersible pump wherein the surface of the intermediate casing facing the backside of the impeller and the bolt heads exposed to the inner side of the pump casing are satisfactorily protected from wear due to abra-sion by earth and sand.

The object above is accomplished according to the present invention.

In an embodiment of the present invention, the surface of the intermediate casing facing the backside of the impeller is covered by a member made of anti-abrasion material and the bolt heads are also disposed so as to be surrounded by such member.

The invention will become more clear when the detailed description of the preferred embodiment is reviewed in conjunction with the accompanying drawings, a brief explanation of which is summerized below.

DETAILED DESCRIPTION OF PREFERRED EMBODIMENTS

Figure 1:
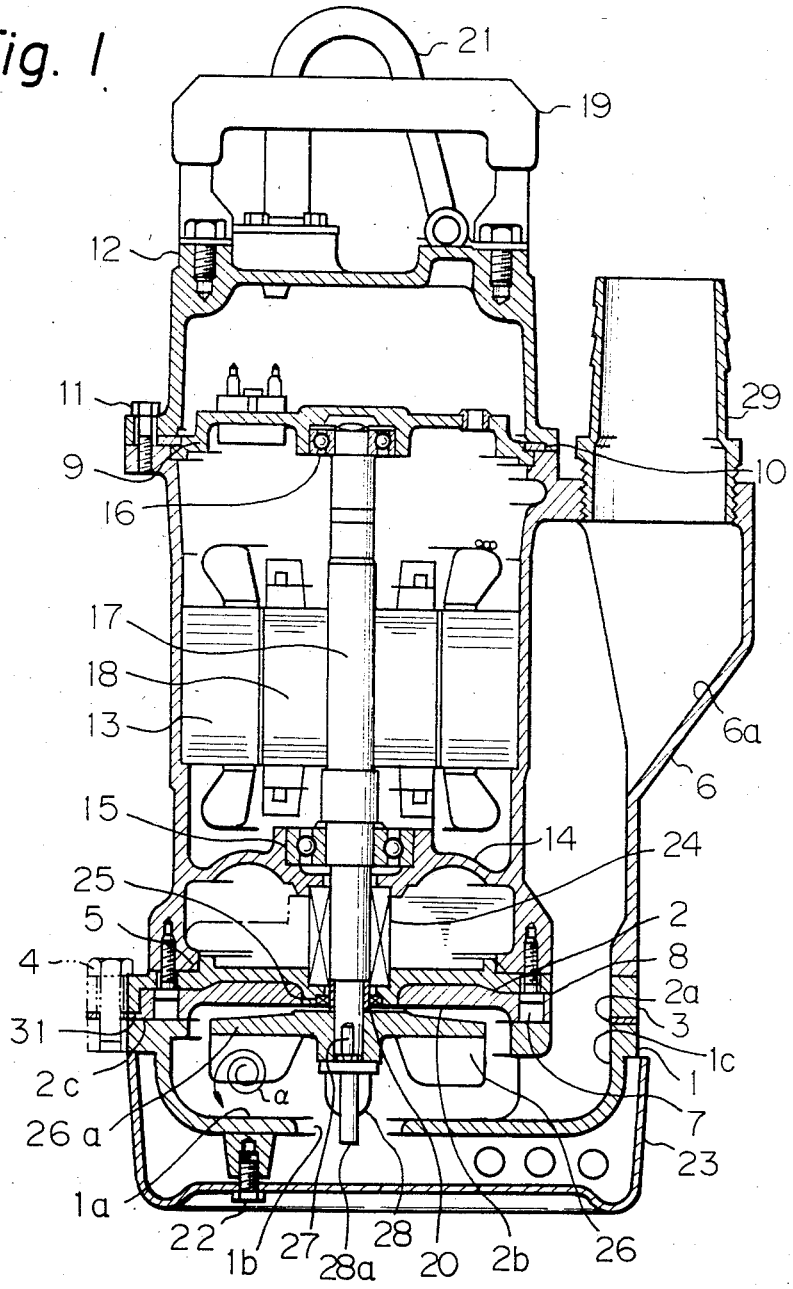
FIG. 1 is a longitudinal cross section of a submersible pump according to the present invention.

Referring to FIG. 1, there is shown a cross sectional view of the submersible pump as an embodiment constructed according to the present invention. The pump comprises three major casing portions, namely a pump casing 1, an intermediate casing 3 and a motor frame 6. The intermediate casing 3 is coupled to the motor frame 6 by being fitted into the latter with a sealing ring 5 interposed therebetween and the casing 3 and the frame 6 are secured to each other by plural bolts 8, the heads of the bolts 8 being abutted against the surface of the intermediate casing 3. The pump casing 1 is secured to the intermediate casing 3 through plural bolts 4 with a protecting member 2 interposed therebetween. The protecting member 2 may be made of rigid rubber, rigid plastic or the like and provided with plural through holes at its periphery for receiving the bolts 4 therethrough to secure the pump casing 1 to the intermediate casing 3.

In the motor frame 6, an intermediate bracket 9 is fitted thereinto at the upper side of the frame 6 and a motor cover 12 is attached on the intermediate bracket 9 with a sealing member 10 interposed therebetween. The cover 12 is fastened to the frame 6 by means of a plurality of bolts 11 together with the bracket 9 being firmly positioned in place. Inside of the motor frame 6, a stator 13 is stationarily held. Bearings 15 and 16 are centrally mounted on a lower partition 14 of the frame 6 and the intermediate bracket 9, respectively, so as to rotatably support a main shaft 17 together with a rotor 18 firmly secured to the shaft. The main shaft 17 extends downwardly through a mechanical seal 24 disposed in a sealing chamber between the partition 14 and the intermediate casing 3 and an oil seal 25 disposed in the intermediate casing so that the distal end of the shaft 17 reaches the inside of the pump casing. Near the distal end of the shaft 17, a sleeve 20 is installed on the shaft. At the distal end of the shaft 17, a semi-open type impeller 26 is mounted thereon and is secured thereto through a key 27 and fastened against the bottom of the sleeve 20 by a nut 28 having a single vane 28*a* at the tip end thereof.

A handle 19 is attached to the motor cover 12. Through the motor cover 12, a cable 21 extends so as to be led to an electric power source. Also, at the portion below the pump casing 1, a strainer 23 is secured by bolts 22.

The front end of the semi-open type impeller 26 is spaced from the inner surface 1*a* of the end wall of the pump casing having a suction opening 1*b*. The vane 28*a* extends slightly downwardly through the suction opening 1*b*. A discharge opening 1*c* of the pump casing is led to a discharge passage 6*a* through a discharge perforation 2*a* in the protecting member 2. At the discharge port of the passage 6*a*, a nipple 29 is threadably attached so that a delivery hose may be coupled thereto.

Figure 2:
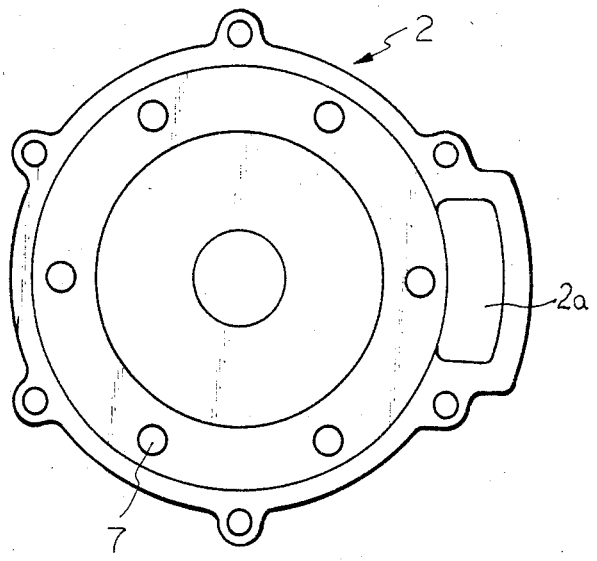
FIG. 2 is a planar top view of a protecting member used in the pump shown in FIG. 1.
Figure 3:
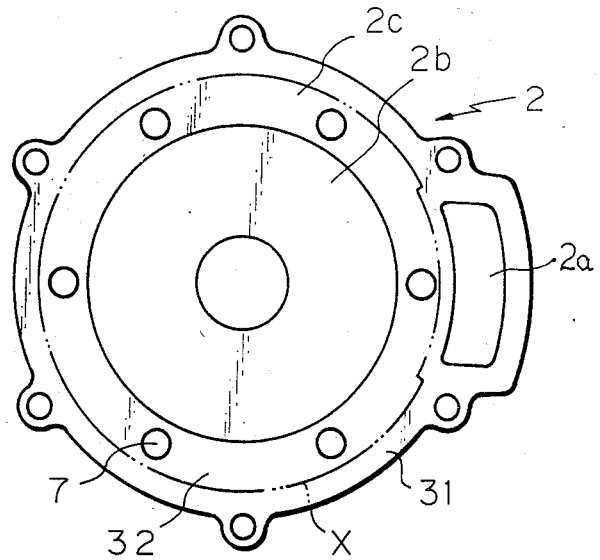
FIG. 3 is a planar bottom view of the protecting member shown in FIG. 2.

FIG. 2 and FIG. 3 illustrate the protecting member 2 in an upper plan view and a lower plan view thereof, respectively. As shown in FIG. 1, the protecting member 2 is disposed on the lower surface of the intermediate casing 3 facing the backside of a shroud 26*a* of the impeller 26. The backside of the impeller shroud 26*a* is arranged to be inclined downwardly, as viewed in FIG. 1, so as to prevent foreign material from building up or being deposited on the backside surface of the shroud 26*a* at the time when the pump is de-energized and stopped. The lower surface of the protecting member 2 is recessed to form a concave flat surface 2*b* and a surface 2*c* surrounding the surface 2*b* is made coplanar so that the surface 2*c* seats on the upper surface of the pump casing 1 to complete the sealing therebetween. The upper surface of the protecting member 2 contacts the intermediate casing 3. The protecting member 2 is generally made of rigid rubber or rigid plastic having anti-wear resistance against the abrasion of earth and sand. The member may be unitarily molded to its final shape which is adapted to intimately contact the intermediate casing 3.

As illustrated in FIG. 3, the coplanar surface 2*c* is divided into two parts, as shown by a two dotted chained line X in FIG. 3, namely an outer area and an inner area. The outer area is a portion 31 serving as a seal packing between the pump casing 1 and the intermediate casing 3 and the inner area 32 is a portion having holes 7 which are adapted to surround the bolt heads of the bolts 8 to protect the bolt heads from abrasion by earth and sand. The respective thicknesses of the outer portion 31 and the inner portion 32 are arranged to be slightly different so that the portion 31 is compressed more firmly by the bolts 4 to provide water tightness than the portion 32 which is provided to protect the bolt heads and need not be compressed firmly. The difference in thickness is given as a step provided on the surface 2*c* adapted to contact the pump casing 1. Accordingly, in the assembled state, liquid may not leak between the opposite surfaces of the portion 31 and the pump casing 1 or intermediate casing 3. However, the thickness of the portion 32 is preferably arranged to be compressed with rather weak force to such an extent that earth and sand may not enter between the opposite surfaces corresponding to the portion 32 of the protecting member 2 and the pump casing 1 or the intermediate casing 3 while the liquid containing earth and sand may enter the holes 7 during the operation of the pump. Further, in the assembled state, the thickness of the outer portion 31 serving as the seal packing is compressed to be thinner than that of the inner portion 32 serving to protect the bolt heads whereby the compression ratio of the outer portion 31 is made large to provide good sealing effect.

Upon energization of the motor, the shaft 17 is rotated together with the impeller 26 to suck liquid containing the earth and sand through the suction opening 1*b*. The vane 28*a* assists sucking by agitating the liquid and prevents clogging at the suction opening 1*b* as well as preventing sand from depositing just below the suction opening 1*b*. Further, since the vane 28*a* extends downwardly slightly beyond the suction opening, abrasion imposed thereon due to the earth and sand is relatively alleviated compared to the situation where the nut 28 is disposed completely within the pump casing. Also, the body of the nut 28 is preferably made with a streamlined shape so as to reduce wear. The presence of the vane 28*a* below the impeller 26 may partly assist suction where the level of liquid is lowered below the impeller 26.

The liquid containing earth and sand sucked inside of the pump casing 1 is caused to generate vortex "$\alpha$" as indicated in FIG. 1 and this vortex "$\alpha$" is moved along with the rotation of the impeller 26 and discharged outwardly through the discharge opening 1*c*, discharge passage 6*a* and the hose coupled to the nipple 29.

During the operation of the submersible pump, if the liquid contains a relatively large amount of sand, pebbles or the like, or in a case where the total amount of liquid remaining in a pool or pond is relatively small, a relatively large amount of sand, pebbles or the like move with the liquid around the backside surface of the shroud 26*a* and contacts the surface of the protecting member 2. However, since the protecting member 2 is made of wear resisting material, the member 2 is not worn easily. Also, the heads of the bolts securing the intermediate casing 3 to the motor frame 6 are surrounded by the protecting member 2 within the holes 7 thereof. Therefore, even if sand or pebbles are contained in the liquid they do not contact with the heads of the bolts 8 with kinetic energy whereby wear on the bolt heads does not occur.

At the space between the backside of the shroud 26*a* and the protecting member 2, turbulent flow of the liquid containing earth and sand may be generated. In the conventional submersible pump wherein such space is relatively narrow, the flowing speed of the liquid in such space is relatively rapid thereby promoting wear of the members contacting the flow. In contrast, in the submersible pump according to the present invention, since the space between the protecting member 2 and the backside of the shroud 26*a* is arranged to be relatively wide, especially at the outer peripheral portion of the shroud 26*a*, the flowing speed of the turbulent flow is made relatively slower whereby the abrasion effect is also alleviated. Therefore, with only the provision of the protecting member 2, operable period of the pump is expected to be longer.

Figure 4:
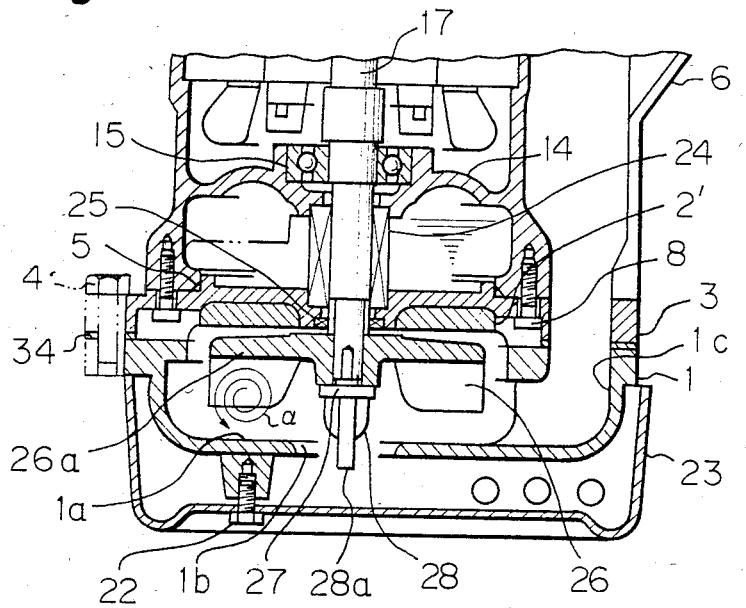
FIG. 4 illustrates in faction a longitudinal cross section of a modified submersible pump.

In FIG. 4, there is shown a modification to FIG. 1 and, for the convenience of explanation, all the references are given the same numbers as those in FIG. 1 except for 2' and 34. In this case, the protecting member 2' is molded onto the intermediate casing 3 with a diameter slightly greater than the diameter of the shroud 26*a*. Therefore, it is also necessary to provide an independent seal packing 34 between the pump casing 1 and the intermediate casing so that the packing 34 serves as a sealing member equivalent to the outer portion 31 shown in FIG. 3. In this embodiment, the protecting member 2 is arranged to protect the portion of the intermediate casing most severelly subjected to the turbulent flow. The heads of the bolts 8 are also not subjected to any substantial extent by severe turbulent flow.

Figure 5:
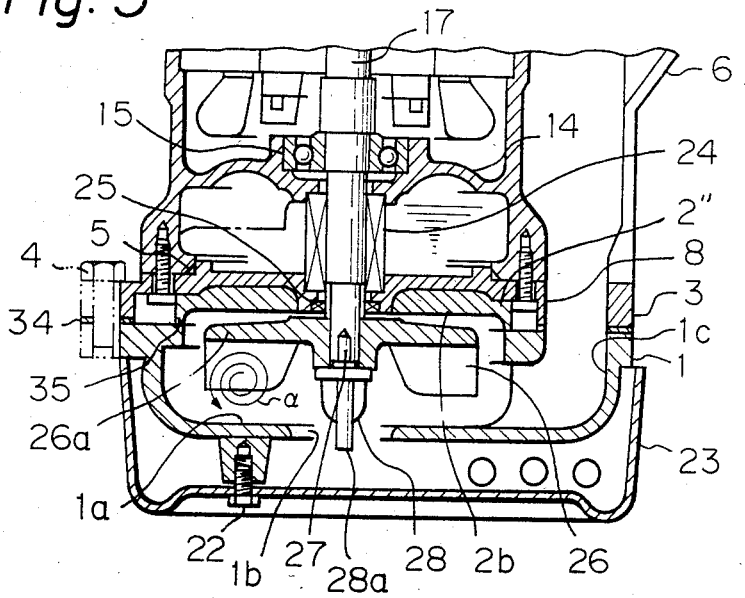
FIG. 5 is a longitudinal cross sectional view of another embodiment of the submersible pump.

FIG. 5 illustrates another modification of the embodiment shown in FIG. 4. All the references are the same as those shown in FIG. 4 except for 2" and 35. In this case, the protecting member 2" is molded with a peripheral ridge 35 which is arranged to positively contact the pump casing 1 so as to isolate the heads of the bolts 8 from the turbulent flow. With the provision of the protecting member according to the present invention, the surface of the intermediate casing is also protected from corrosion even if the intermediate casing is made of a material having a low anti-corrosion feature because the surface of the intermediate casing exposed to the liquid flow is substantially covered by the protecting member.

While the present invention has been explained in detail referring to the specific embodiments, the present invention is not limited to those explained above and it may be modified or changed by those skilled in the art within the sprit and scope of the present invention defined by the claims appended hereto.

What is claimed is:

1. A submersible pump comprising:

(a) a motor section having a motor encased within a motor frame;

(b) a pump section having a pump casing and a semi-open type impeller including a shroud mounted on the distal end of a motor shaft extending from said motor into said pump casing;

(c) an intermediate casing fastened to said motor frame by a plurality of bolts the heads of which bear against the side of said intermediate casing opposite said motor frame, said pump casing being mounted on the side of said intermediate casing opposite said motor frame and having a hole therethrough which permits said motor shaft to extend therethrough from said motor to the interior of said pump casing; and (d) a protecting member disposed between said intermediate casing and said pump casing, said protecting member having a surface which opposes the backside of the shroud of said impeller, said protecting member being made of wear-resistant material and being sized, shaped, and positioned to surround the heads of said bolts, the surface of said shroud which opposes the backside of the shroud of said impeller being canted relative to said protecting member so that the radial outer edge of said shroud is spaced from said protecting member by a larger distance than is the radial inner edge of said shroud, said protecting member comprising:

(i) a radially inner portion including the surface of said protecting member which opposes the backside of the shroud of said impeller, the surface of said protecting member which opposes the backside of the shroud being recessed to form a concave flat surface, and (ii) an annular flange which extends radially outwardly from said radially inner portion, said annular flange in turn being divided into a radially outer portion and a radially inner portion, the radially outer portion of said annular flange serving as a seal packing between said pump casing and said intermediate casing and the radially inner portion containing a plurality of holes each one of which surrounds the head of one of said bolts, said annular flange, said intermediate casing, and said pump casing being sized and shaped so that said pump casing sealingly closes said plurality of holes, preventing liquid from entering said holes during use of the submersible pump.

2. A submersible pump as claimed in claim 1 wherein said impeller is secured to the distal end of said motor shaft by a nut threadably engaging said distal end, said nut being provided with a single vane at its tip and said single vane being arranged to extend through and slightly beyond a suction opening in said pump casing through which liquid enters the interior of said pump casing during use of the submersible pump.

3. A submersible pump as claimed in any one of claims 1 or 2 wherein said wear-resistant material is rigid rubber.

4. A submersible pump as claimed in claims 1 or 2 wherein said wear-resistant material is rigid plastic.

5. A submersible pump as recited in claim 1 wherein said annular flange, said intermediate casing, and said pump casing are sized and shaped so that the radially outer portion of said annular flange is compressed more firmly by said bolts than is the radially inner portion of said annular flange.

* * * * *